US012312775B2

(12) United States Patent
Matsuyama

(10) Patent No.: US 12,312,775 B2
(45) Date of Patent: May 27, 2025

(54) CONSTRUCTION MACHINE CONTROL SYSTEM AND CONSTRUCTION MACHINE CONTROL METHOD

(71) Applicant: Komatsu Ltd., Tokyo (JP)

(72) Inventor: Toru Matsuyama, Tokyo (JP)

(73) Assignee: KOMATSU LTD., Tokyo (JP)

( * ) Notice: Subject to any disclaimer, the term of this patent is extended or adjusted under 35 U.S.C. 154(b) by 510 days.

(21) Appl. No.: 17/421,086

(22) PCT Filed: Jan. 9, 2020

(86) PCT No.: PCT/JP2020/000524
§ 371 (c)(1),
(2) Date: Jul. 7, 2021

(87) PCT Pub. No.: WO2020/158331
PCT Pub. Date: Aug. 6, 2020

(65) Prior Publication Data

US 2022/0120059 A1 Apr. 21, 2022

(30) Foreign Application Priority Data

Jan. 31, 2019 (JP) ..... 2019-016477

(51) Int. Cl.
*E02F 9/26* (2006.01)
*E02F 3/43* (2006.01)
*E02F 9/22* (2006.01)

(52) U.S. Cl.
CPC ..... *E02F 9/262* (2013.01); *E02F 3/435* (2013.01); *E02F 9/2203* (2013.01); *E02F 9/2228* (2013.01)

(58) Field of Classification Search
CPC ..... E02F 9/262; E02F 3/435; E02F 9/2203
USPC ..... 701/50
See application file for complete search history.

(56) References Cited

U.S. PATENT DOCUMENTS 5,835,874 A * 11/1998 Hirata ..... E02F 3/301 60/426
7,979,181 B2 * 7/2011 Clark ..... E02F 9/2029 701/50
8,942,895 B2 1/2015 Nomura et al.
9,540,793 B2 1/2017 Kami et al.
9,650,755 B2 5/2017 Nomura et al.
(Continued)

FOREIGN PATENT DOCUMENTS

CN 105765134 A 7/2016
CN 106460360 A 2/2017
(Continued)

*Primary Examiner* — Tuan C To
(74) *Attorney, Agent, or Firm* — Troutman Pepper Locke LLP

(57) ABSTRACT

A control system of a construction machine comprises: a determination unit that determines a control object surface from a first design surface and a second design surface adjacent to the first design surface on the basis of a distance between a tilt bucket and the first design surface and a distance between the tilt bucket and the second design surface; a working equipment control unit that controls a tilt axis of the tilt bucket on the basis of the control object surface determined by the determination unit; and a display control unit that causes a display device to use different display modes to display the control object surface and a surface other than the control object surface.

6 Claims, 11 Drawing Sheets

(56) References Cited

U.S. PATENT DOCUMENTS

| | | | | |
|---|---|---|---|---|
| 10,196,796 | B2 | 2/2019 | Iwamura et al. | |
| 10,301,794 | B2 | 5/2019 | Moriki et al. | |
| 10,508,417 | B2 | 12/2019 | Hasegawa et al. | |
| 10,774,502 | B2 | 9/2020 | Sakai et al. | |
| 11,015,319 | B2 | 5/2021 | Izumikawa | |
| 11,434,621 | B2 * | 9/2022 | Uhlin | E02F 3/434 |
| 2013/0158787 | A1 | 6/2013 | Nomura et al. | |
| 2014/0099178 | A1 * | 4/2014 | Nomura | E02F 9/26 414/685 |
| 2014/0100712 | A1 * | 4/2014 | Nomura | E02F 9/264 701/1 |
| 2014/0200776 | A1 | 7/2014 | Matsuyama et al. | |
| 2015/0345114 | A1 | 12/2015 | Nomura et al. | |
| 2016/0244950 | A1 | 8/2016 | Kami et al. | |
| 2017/0175364 | A1 | 6/2017 | Hasegawa et al. | |
| 2017/0284057 | A1 * | 10/2017 | Moriki | E02F 9/2041 |
| 2017/0342678 | A1 | 11/2017 | Iwamura et al. | |
| 2018/0002900 | A1 * | 1/2018 | Morimoto | E02F 9/261 |
| 2018/0016768 | A1 | 1/2018 | Izumikawa | |
| 2018/0051446 | A1 * | 2/2018 | Yoshinada | E02F 9/264 |
| 2018/0167588 | A1 * | 6/2018 | Izumikawa | E02F 3/40 |
| 2019/0127946 | A1 | 5/2019 | Sakai et al. | |
| 2019/0292747 | A1 * | 9/2019 | Takehara | E02F 9/262 |
| 2019/0330825 | A1 * | 10/2019 | Tanimoto | E02F 9/261 |

FOREIGN PATENT DOCUMENTS

| | | | | |
|---|---|---|---|---|
| CN | 107268699 | A | 10/2017 | |
| DE | 112012000106 | T5 | 7/2013 | |
| EP | 1650357 | A1 * | 4/2006 | B66F 9/065 |
| JP | 2013-217138 | A | 10/2013 | |
| JP | 2014074319 | A | 4/2014 | |
| JP | 6046320 | B1 | 12/2016 | |
| JP | 2017-179961 | A | 10/2017 | |
| JP | 2018-003514 | A | 1/2018 | |
| KR | 20170113046 | A | 10/2017 | |
| KR | 20170131484 | A | 11/2017 | |
| KR | 20170136415 | A | 12/2017 | |

* cited by examiner

CONSTRUCTION MACHINE CONTROL SYSTEM AND CONSTRUCTION MACHINE CONTROL METHOD

FIELD

The present invention relates to a construction machine control system and a construction machine control method.

BACKGROUND

In technological fields pertaining to construction machines, construction machine control systems like that disclosed in Patent Literature 1, which control a tilt bucket on the basis of a target construction data representing a target shape for a construction object, are known.

CITATION LIST

Patent Literature

Patent Literature 1: Japanese Patent Publication No. 6046320

SUMMARY

Technical Problem

The target construction data sometimes include a first design surface and a second design surface adjacent to the first design surface. When the tilt bucket is controlled so as to track the first design surface, the driver of the construction machine must operate an operating device for driving working equipment to bring the tilt bucket close to the first design surface. When it takes time to bring the tilt bucket close to the first design surface, work efficiency may be reduced.

An object of an aspect of the present invention is to suppress a reduction in the work efficiency of a construction machine having a tilt bucket.

Solution to Problem

According to an aspect of the present invention, a control system of a construction machine provided with working equipment which includes an arm and a tilt bucket, the control system comprises: a determination unit that determines a control object surface from a first design surface and a second design surface adjacent to the first design surface on the basis of a distance between the tilt bucket and the first design surface and a distance between the tilt bucket and the second design surface; a working equipment control unit that controls a tilt axis of the tilt bucket on the basis of the control object surface determined by the determination unit; and a display control unit that causes a display device to use different display modes to display the control object surface and a surface other than the control object surface.

Advantageous Effects of Invention

According to an embodiment of the present invention, a reduction in the work efficiency of a construction machine having a tilt bucket can be suppressed.

DESCRIPTION OF EMBODIMENTS

Although embodiments of the present invention are described hereinbelow with reference to the drawings, the present invention is not limited to or by such embodiments. Constituent elements of the embodiments described hereinbelow can be suitably combined. Moreover, some of the constituent elements may also not be used.

In the description hereinbelow, the positional relationships between the parts are described by defining a three-dimensional vehicle-body coordinate system (X, Y, Z). The vehicle-body coordinate system refers to a coordinate system based on an origin which is fixed to the construction machine. The vehicle-body coordinate system is defined by an X axis that extends in a defined direction with reference to an origin which is set to the construction machine, a Y axis which orthogonally intersects the X axis, and a Z axis which orthogonally intersects the X axis and the Y axis, respectively. A direction parallel to the X axis is taken to be an X-axis direction. A direction parallel to the Y axis is taken to be a Y-axis direction. A direction parallel to the Z axis is taken to be a Z-axis direction. A direction of rotation or inclination about the X axis is taken to be a θX direction. A direction of rotation or inclination about the Y axis is taken to be a θY direction. A direction of rotation or inclination about the Z axis is taken to be a θZ direction.

First Embodiment

Figure 1:
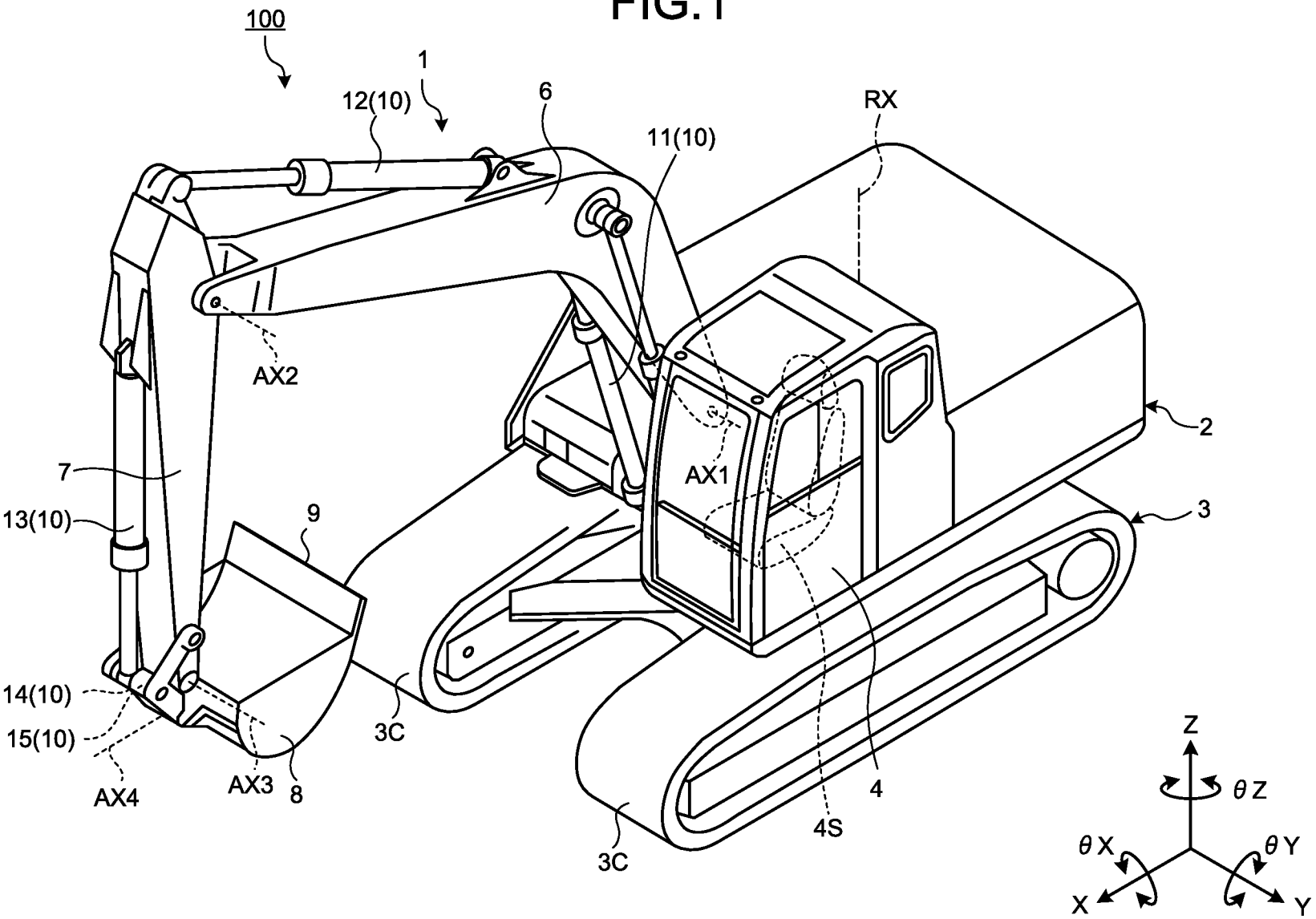
FIG. 1 is a perspective view of an example of a construction machine according to a first embodiment.

FIG. 1 is a perspective view of an example of a construction machine 100 according to this embodiment. In this embodiment, an example in which the construction machine 100 is an excavator is described. In the description hereinbelow, the construction machine 100 is, where appropriate, referred to as the excavator 100.

As illustrated in FIG. 1, the excavator 100 is provided with working equipment 1 that is hydraulically operated; a swing body 2 that supports the working equipment 1; and a traveling body 3 that supports the swing body 2. The swing body 2 has a driver cabin 4 in which a driver rides. A seat 4S on which the driver sits is disposed in the driver cabin 4. The swing body 2 is capable of swinging about a swing axis RX so as to be supported by the traveling body 3.

The traveling body 3 has a pair of crawler tracks 3C. The excavator 100 travels due to the rotation of the crawler tracks 3C. Note that the traveling body 3 may also have tires.

The working equipment 1 is supported on the swing body 2. The working equipment 1 has a boom 6 connected to the swing body 2, an arm 7 connected to the distal end of the boom 6, and a bucket 8 connected to the distal end of the arm 7. The bucket 8 has a blade edge 9. In this embodiment, the blade edge 9 of the bucket 8 is the distal end of a straight-shaped blade. Note that the blade edge 9 of the bucket 8 may also be the distal end of a convex-shaped blade provided to the bucket 8.

The boom 6 is rotatable with respect to the swing body 2 about a boom axis AX1. The arm 7 is rotatable with respect to the boom 6 about an arm axis AX2. In this embodiment, the bucket 8 is a tilt bucket. The bucket 8 is rotatable with respect to the arm 7 about a bucket axis AX3 and a tilt axis AX4, respectively. The boom axis AX1, the arm axis AX2, and the bucket axis AX3 run parallel to the Y axis. The tilt axis AX4 orthogonally intersects the bucket axis AX3. The swing axis RX runs parallel to the Z axis. The X-axis direction is a front-back direction of the swing body 2. The Y-axis direction is a vehicle-width direction of the swing body 2. The Z-axis direction is an up-down direction of the swing body 2. The direction in which the working equipment 1 exists is a forward direction with reference to the driver sitting on the seat 4S.

<Control System>

Figure 2:
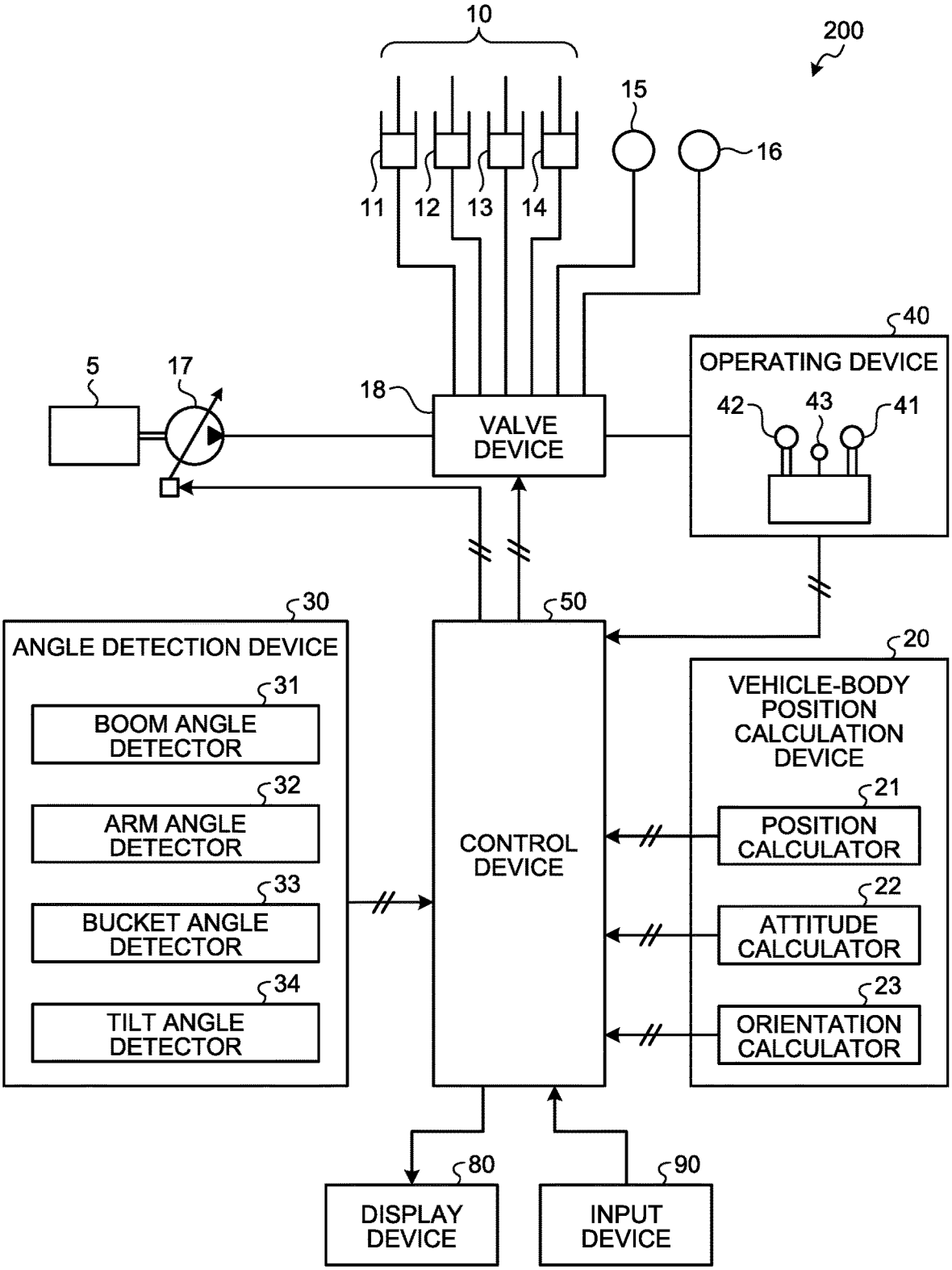
FIG. 2 is a block diagram illustrating an example of a construction machine control system according to the first embodiment.
Figure 3:
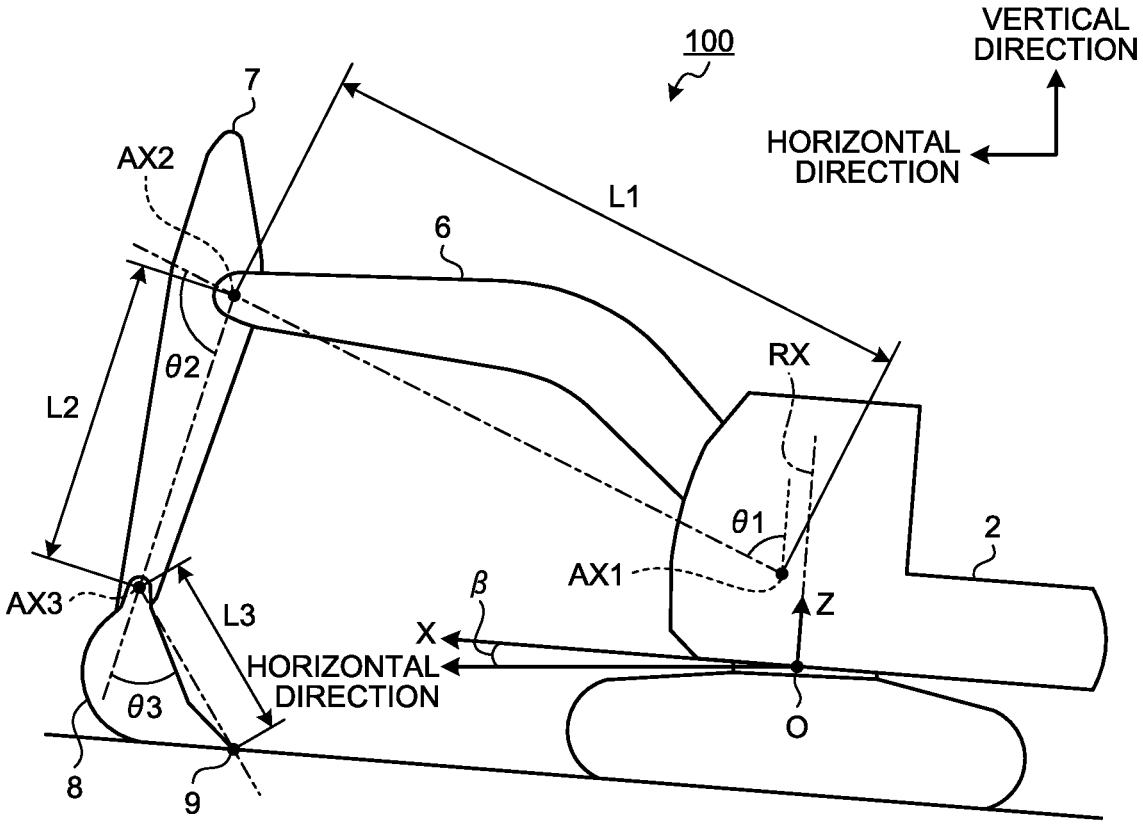
FIG. 3 is a diagram schematically illustrating a construction machine according to the first embodiment.

FIG. 2 is a block diagram illustrating an example of a control system 200 of an excavator 100 according to this embodiment. FIG. 3 is a diagram schematically illustrating the excavator 100 according to this embodiment. FIG. 4(A) and FIG. 4(B) are diagrams is a diagram schematically illustrating the bucket 8 according to this embodiment.

As illustrated in FIG. 2, the control system 200 of the excavator 100 is provided with: an engine 5; a plurality of hydraulic cylinders 10 that drive the working equipment 1; a swing motor 16 that drives the swing body 2; a travel motor 15 that drives the traveling body 3; a hydraulic pump 17 that discharges hydraulic fluid; a valve device 18 that distributes the hydraulic fluid discharged from the hydraulic pump 17 to the plurality of hydraulic cylinders 10, the travel motor 15, and the swing motor 16, respectively; a vehicle-body position calculation device 20 that calculates position data of the swing body 2; an angle detection device 30 that detects an angle θ of the working equipment 1; an operating device 40 that operates at least part of the excavator 100; a control device 50; a display device 80; and an input device 90.

The working equipment 1 operates due to the motive power generated by the hydraulic cylinders 10. The hydraulic cylinders 10 perform driving on the basis of the hydraulic fluid supplied from the hydraulic pump 17. The hydraulic cylinders 10 include a boom cylinder 11 that causes the boom 6 to operate, an arm cylinder 12 that causes the arm 7 to operate, and a bucket cylinder 13 and a tilt cylinder 14 that cause the bucket 8 to operate. The boom cylinder 11 generates motive power that causes the boom 6 to rotate about the boom axis AX1. The arm cylinder 12 generates motive power that causes the arm 7 to rotate about the arm axis AX2. The bucket cylinder 13 generates motive power that causes the bucket 8 to rotate about the bucket axis AX3. The tilt cylinder 14 generates motive power that causes the bucket 8 to rotate about the tilt axis AX4.

In the description hereinbelow, the rotation of the bucket 8 about the bucket axis AX3 is suitably called bucket rotation, and the rotation of the bucket 8 about the tilt axis AX4 is suitably called tilt rotation.

The swing body 2 swings due to the motive power generated by the swing motor 16. The swing motor 16 is a hydraulic motor and performs driving on the basis of the hydraulic fluid supplied from the hydraulic pump 17. The swing motor 16 generates motive power that causes the swing body 2 to swing about the swing axis RX.

The traveling body 3 travels due to the motive power generated by the travel motor 15. The travel motor 15 is a hydraulic motor and performs driving on the basis of the hydraulic fluid supplied from the hydraulic pump 17. The travel motor 15 generates motive power that causes the traveling body 3 to advance and retreat.

The engine 5 is mounted in the swing body 2. The engine 5 generates motive power for driving the hydraulic pump 17.

The hydraulic pump 17 discharges hydraulic fluid for driving the hydraulic cylinders 10, the swing motor 16, and the travel motor 15.

The valve device 18 has a plurality of valves that distribute the hydraulic fluid supplied from the hydraulic pump 17 to the plurality of hydraulic cylinders 10, the swing motor 16, and the travel motor 15. The valve device 18 adjusts the flow rate of the hydraulic fluid supplied to each of the plurality of hydraulic cylinders 10. The operating speed of the working equipment 1 is adjusted by adjusting the flow rate of the hydraulic fluid supplied to the hydraulic cylinders 10. The valve device 18 adjusts the flow rate of the hydraulic fluid supplied to the swing motor 16. The swing speed of the swing body 2 is adjusted by adjusting the flow rate of the hydraulic fluid supplied to the swing motor 16. The valve device 18 adjusts the flow rate of the hydraulic fluid supplied to the travel motor 15. The travel speed of the traveling body 3 is adjusted by adjusting the flow rate of the hydraulic fluid supplied to the travel motor 15.

The vehicle-body position calculation device 20 calculates position data of the swing body 2. The position data of the swing body 2 includes the position of the swing body 2, the attitude of the swing body 2, and the orientation of the swing body 2. The vehicle-body position calculation device 20 has a position calculator 21 that calculates the position of the swing body 2, an attitude calculator 22 that calculates the attitude of the swing body 2, and an orientation calculator 23 that calculates the orientation of the swing body 2.

The position calculator 21 calculates, as the position of the swing body 2, the position of the swing body 2 in a global coordinate system. The position calculator 21 is disposed on the swing body 2. The global coordinate system denotes a coordinate system with reference to an origin which is fixed to the earth. The global coordinate system is a coordinate system defined by a global navigation satellite system (GNSS). GNSS refers to a global navigation satellite system. An example of a global navigation satellite system is a global positioning system (GPS). A GNSS has a plurality of positioning satellites. A GNSS detects positions defined by latitude, longitude, and altitude coordinate data. A GPS antenna is provided to the swing body 2. The GPS antenna receives radio waves from GPS satellites and outputs, to the position calculator 21, a signal generated on the basis of the received radio waves. The position calculator 21 calculates the position of the swing body 2 in the global coordinate system on the basis of the signal supplied from the GPS antenna. The position calculator 21 calculates the position of a representative point O of the swing body 2 as illustrated in FIG. 3, for example. In the example illustrated in FIG. 3, the representative point O of the swing body 2 is set on the swing axis RX. Note that the representative point O may also be set on the boom axis AX1.

The attitude calculator 22 calculates, as the attitude of the swing body 2, angles of inclination of the swing body 2 relative to the horizontal plane in the global coordinate system. The attitude calculator 22 is disposed on the swing body 2. The attitude calculator 22 includes an inertial measurement unit (IMU). The angles of inclination of the swing body 2 relative to the horizontal plane include a roll angle $\alpha$ representing the angle of inclination of the swing body 2 in the vehicle-width direction, and a pitch angle $\beta$ representing the angle of inclination of the swing body 2 in the front-back direction.

The orientation calculator 23 calculates, as the orientation of the swing body 2, the orientation of the swing body 2 relative to a reference orientation in the global coordinate system. The reference orientation is north, for example. The orientation calculator 23 is disposed on the swing body 2. The orientation calculator 23 includes a gyro sensor. Note that the orientation calculator 23 may also calculate the orientation on the basis of the signal supplied from the GPS antenna. The orientation of the swing body 2 relative to the reference orientation includes a yaw angle $\gamma$ representing the angle formed between the orientation of the swing body 2 and the reference orientation.

Figure 4:
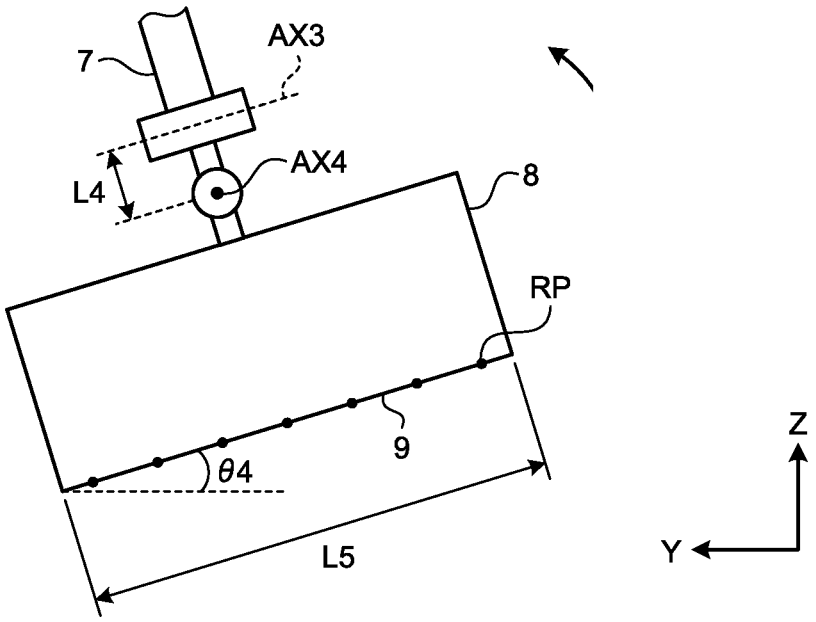
FIG. 4(A) and FIG. 4(B) are diagrams schematically illustrating a bucket according to the first embodiment.
Figure 4:
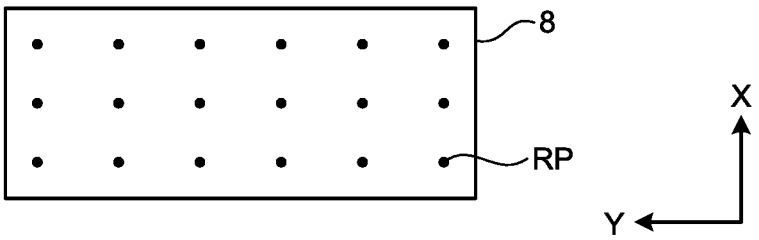

The angle detection device 30 detects the angle $\theta$ of the working equipment 1. The angle detection device 30 is disposed on the working equipment 1. As illustrated in FIGS. 3 and 4, the angle $\theta$ of the working equipment 1 includes a boom angle $\theta$1 representing the angle of the boom 6 relative to the Z axis, an arm angle $\theta$2 representing the angle of the arm 7 relative to the boom 6, a bucket angle $\theta$3 representing the angle of the bucket 8 in the bucket rotation direction relative to the arm 7, and a tilt angle $\theta$4 representing the angle of the bucket 8 in the tilt-rotation direction relative to a plane XY.

The angle detection device 30 has a boom angle detector 31 that detects the boom angle $\theta$1, an arm angle detector 32 that detects the arm angle $\theta$2, a bucket angle detector 33 that detects the bucket angle $\theta$3, and a tilt angle detector 34 that detects the tilt angle $\theta$4. The angle detection device 30 may include a stroke sensor that detects the strokes of the hydraulic cylinders 10 or may include an angle sensor that detects the angle $\theta$ of the working equipment 1 such as a rotary encoder. When the angle detection device 30 includes a stroke sensor, the angle detection device 30 calculates the angle $\theta$ of the working equipment 1 on the basis of detection data of the stroke sensor.

The operating device 40 is operated by the driver in order to drive the hydraulic cylinders 10, the swing motor 16, and the travel motor 15. The operating device 40 is disposed in the driver cabin 4. The working equipment 1 is operated due to the driver operating the operating device 40. The operating device 40 includes levers which are operated by the driver of the excavator 100. The levers of the operating device 40 include a right-operation lever 41, a left-operation lever 42, and a tilt-operation lever 43.

When the right-operation lever 41, which is in a neutral position, is maneuvered forward, the boom 6 is lowered, and when maneuvered backward, the boom 6 is raised. When the right-operation lever 41, which is in a neutral position, is maneuvered rightward, the bucket 8 performs a dumping operation, and when maneuvered leftward, the bucket 8 performs an excavation operation.

When the left-operation lever 42, which is in a neutral position, is maneuvered forward, the arm 7 performs a dumping operation, and when maneuvered backward, the arm 7 performs an excavation operation. When the left-operation lever 42, which is in a neutral position, is maneuvered rightward, the swing body 2 swings rightward, and when maneuvered leftward, the swing body 2 swings leftward.

When the tilt-operation lever 43 is operated, the bucket 8 undergoes tilt rotation.

The operating device 40 also includes a travel lever (not illustrated). Operating the travel lever causes the traveling body 3 to switch between advancing and retreating. The travel speed of the traveling body 3 is adjusted by operating the travel lever.

The display device 80 displays display data. The display device 80 is disposed in the driver cabin 4. Examples of the display device 80 include a flat-panel display such as a liquid crystal display (LCD) or an organic EL (electroluminescence) display (OLED).

The input device 90 is operated by the driver to input input data to the control device 50. The input device 90 is disposed in the driver cabin 4. Examples of the input device 90 are contact-type input devices which are operated manually by the driver such as a computer keyboard, a mouse, a touch panel, an operating switch, and an operating button. Note that the input device 90 may also be a speech input device which is operated via the speech of an administrator.

Control Device

Figure 5:
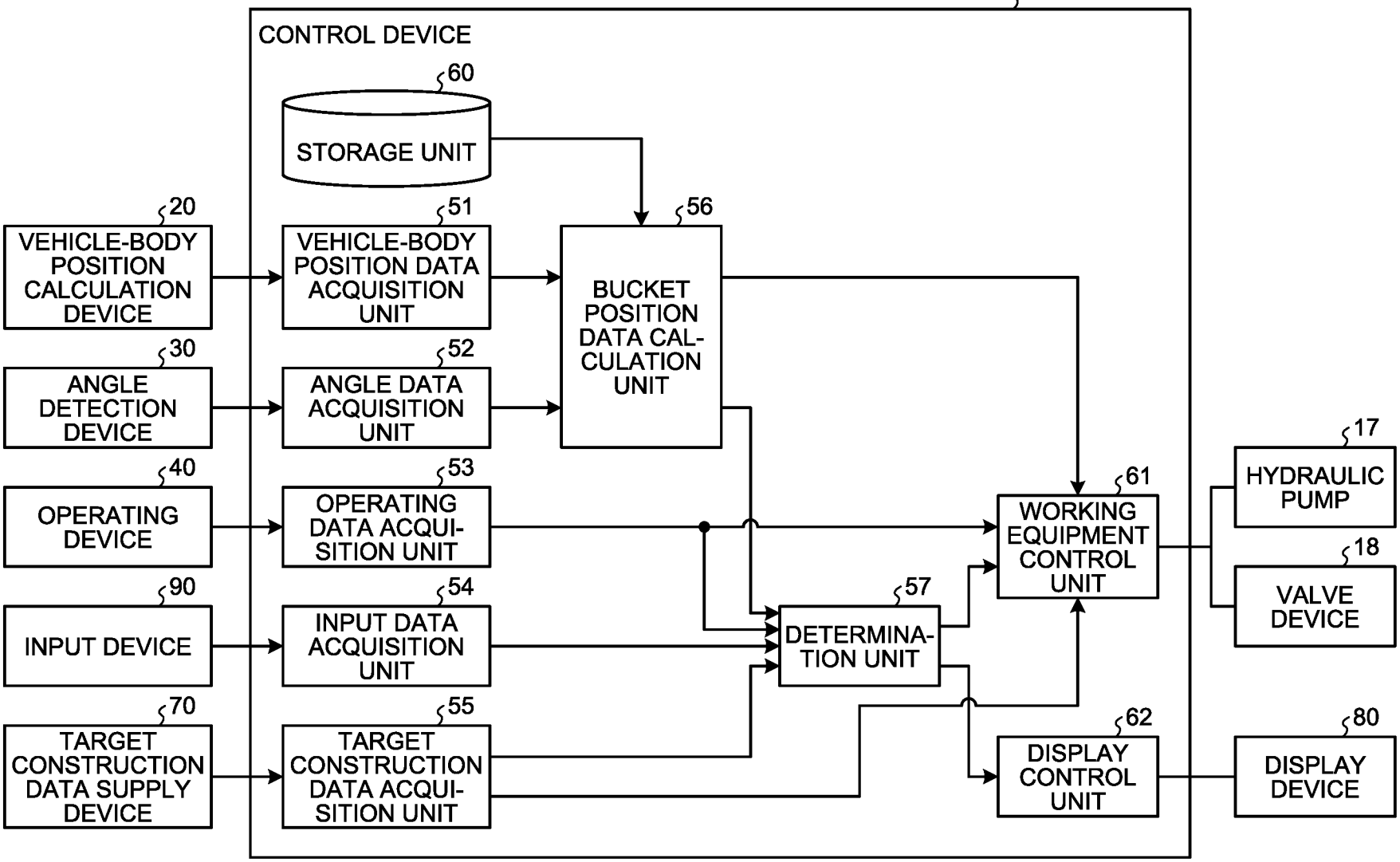
FIG. 5 is a function block diagram illustrating an example of a control device according to the first embodiment.

FIG. 5 is a function block diagram illustrating an example of the control device 50 according to this embodiment. The control device 50 has a vehicle-body position data acquisition unit 51, an angle data acquisition unit 52, an operating data acquisition unit 53, an input data acquisition unit 54, a target construction data acquisition unit 55, a bucket position data calculation unit 56, a determination unit 57, a storage unit 60, a working equipment control unit 61, and a display control unit 62.

The vehicle-body position data acquisition unit 51 acquires position data of the swing body 2 from the vehicle-body position calculation device 20. The position data of the swing body 2 includes the position of the swing body 2, the attitude of the swing body 2, and the orientation of the swing body 2.

The angle data acquisition unit 52 acquires angle data representing the angle $\theta$ of the working equipment 1 from the angle detection device 30. The angle data of the working equipment 1 includes the boom angle $\theta$1, the arm angle $\theta$2, the bucket angle $\theta$3, and the tilt angle $\theta$4.

The operating data acquisition unit 53 acquires operating data which is generated through the operation of the operating device 40. The operating data of the operating device 40 includes the amount the operating device 40 is operated. An operation amount sensor for detecting the amount the levers are operated is provided to the operating device 40. The operating data acquisition unit 53 acquires the operating data of the operating device 40 from the operation amount sensor of the operating device 40. The operating data includes operating data generated in order to cause the working equipment 1 to operate, operating data generated in order to cause the swing body 2 to swing, and operating data generated in order to cause the traveling body 3 to travel.

The input data acquisition unit 54 acquires input data which is generated through the operation of the input device 90.

The target construction data acquisition unit 55 acquires target construction data CS representing a target shape of a construction object. The target construction data CS represents a three-dimensional target shape after construction by the excavator 100. In this embodiment, the target construction data CS is defined in a vehicle-body coordinate system. Note that the target construction data CS may also be defined in a global coordinate system. In this embodiment, the target construction data CS is generated by a target construction data supply device 70. The target construction data acquisition unit 55 acquires the target construction data from the target construction data supply device 70. The target construction data supply device 70 may also be provided in a remote location of the excavator 100. The target construction data CS generated by the target construction data supply device 70 may also be transmitted to the control device 50 via a communications system. Note that the target construction data generated by the target construction data supply device 70 may also be stored in the storage unit 60. The target construction data acquisition unit 55 may also acquire the target construction data CS from the storage unit 60. The target construction data CS is defined in a vehicle-body coordinate system.

The bucket position data calculation unit 56 calculates position data of a regulation point RP set in the bucket 8. The bucket position data calculation unit 56 calculates the position data of the regulation point RP set in the bucket 8 on the basis of the position data of the swing body 2 acquired by the vehicle-body position data acquisition unit 51, the angle data of the working equipment 1 acquired by the angle data acquisition unit 52, and the working equipment data stored in the storage unit 60.

As illustrated in FIGS. 3 and 4, the working equipment data includes a boom length L1, an arm length L2, a bucket length L3, a tilt length L4, and a bucket width L5. The boom length L1 is the distance between the boom axis AX1 and the arm axis AX2. The arm length L2 is the distance between the arm axis AX2 and the bucket axis AX3. The bucket length L3 is the distance between the bucket axis AX3 and the blade edge 9 of the bucket 8. The tilt length L4 is the distance between the bucket axis AX3 and the tilt axis AX4. The bucket width L5 is the dimension of the bucket 8 in the width direction thereof. The working equipment data includes bucket outline data representing the shape and dimensions of the bucket 8. The bucket outline data includes outline data of the bucket 8 which includes the outer surface contour of the bucket 8. The bucket outline data includes coordinate data of a plurality of regulation points RP of the bucket 8 with reference to a predetermined part of the bucket 8.

The bucket position data calculation unit 56 calculates the respective relative positions of the plurality of regulation points RP with respect to the representative point O of the swing body 2. Furthermore, the bucket position data calculation unit 56 calculates the respective absolute positions of the plurality of regulation points RP.

The bucket position data calculation unit 56 is capable of calculating the respective relative positions of the plurality of regulation points RP with respect to the representative point O on the basis of: working equipment data including the boom length L1, the arm length L2, the bucket length L3, the tilt length L4, and the bucket outline data; and working equipment angle data including the boom angle θ1, the arm angle θ2, the bucket angle θ3, and the tilt angle θ4. As illustrated in FIG. 3, the representative point O is set as the swing axis RX of the swing body 2. Note that the representative point O may also be set on the boom axis AX1.

The bucket position data calculation unit 56 is capable of calculating the absolute position of the bucket 8 on the basis of the absolute position of the swing body 2 calculated by the vehicle-body position calculation device 20 and the relative positions of the representative point O and the bucket 8. The absolute position of the swing body 2 and the relative position with respect to the representative point O are existing data derived from various data of the excavator 100. The bucket position data calculation unit 56 is capable of calculating the respective absolute positions of the plurality of regulation points RP of the bucket 8 on the basis of the position data including the absolute position of the swing body 2, the relative positions of the representative point O and the bucket 8, the working equipment data, and the working equipment angle data.

The determination unit 57 determines a control object surface Fc, which is to be used to control the bucket 8, from the target construction data CS acquired by the target construction data acquisition unit 55 and the position data of the regulation points RP acquired by the bucket position data calculation unit 56.

Figure 6:
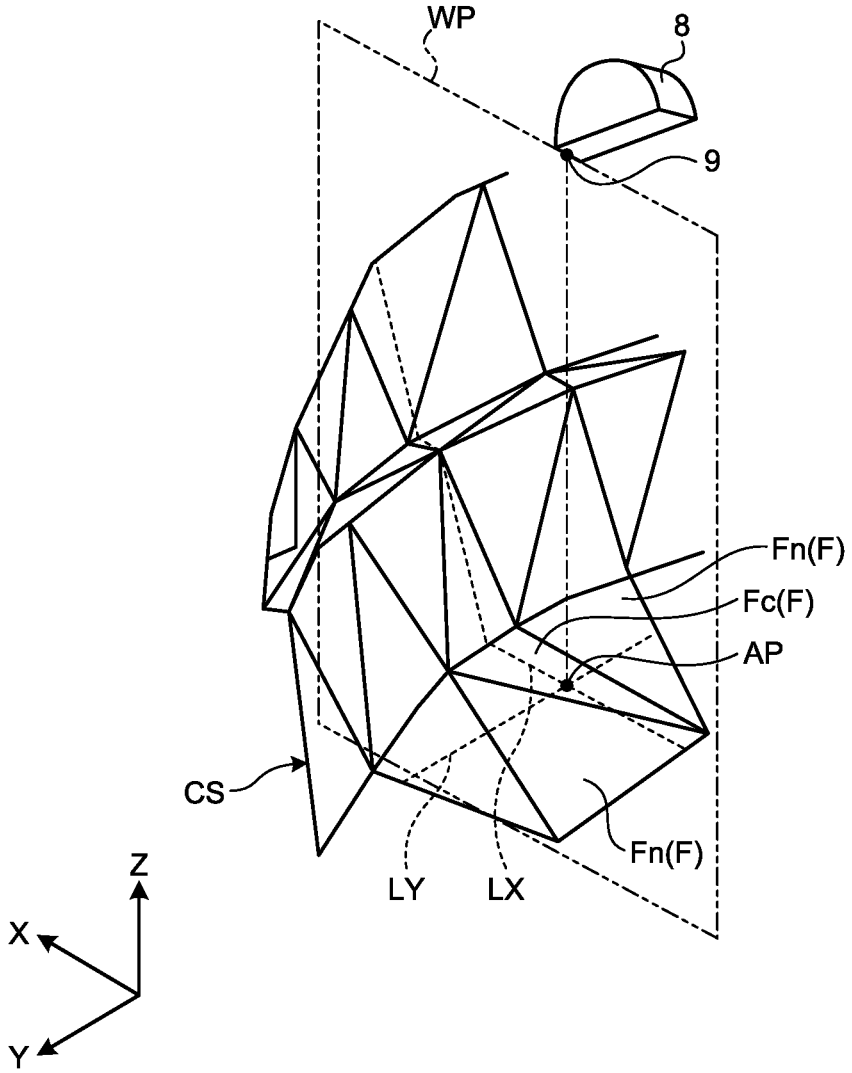
FIG. 6 is a schematic diagram to illustrate an example of processing by a determination unit according to the first embodiment.

FIG. 6 is a schematic diagram to illustrate an example of processing by the determination unit 57 according to this embodiment. As illustrated in FIG. 6, the target construction data CS includes a plurality of design surfaces F. The design surfaces F represent the target shape of the construction object.

The determination unit 57 determines the control object surface Fc used to control the bucket 8 from the plurality of design surfaces F of the target construction data CS. Furthermore, the determination unit 57 determines a non-control object surface Fn which is not used to control the bucket 8 from the plurality of design surfaces F of the target construction data CS. In this embodiment, control of the bucket 8 includes at least control of the tilt axis AX4 of the bucket 8. Control of the tilt axis AX4 of the bucket 8 includes control of at least one of the tilt angle θ4 representing the angle (position) of the bucket 8 in the tilt-rotation direction, the rotation speed of the bucket 8 in the tilt-rotation direction, and the rotation acceleration of the bucket 8 in the tilt-rotation direction.

Note that control of the bucket 8 may also include control of the bucket axis AX3 of the bucket 8. The control of the bucket axis AX3 of the bucket 8 includes control of at least one of the bucket angle θ3 representing the angle (position) of the bucket 8 in the bucket rotation direction, the rotation speed of the bucket 8 in the bucket rotation direction, and the rotation acceleration of the bucket 8 in the bucket rotation direction.

For the bucket 8, the tilt axis AX4 is controlled on the basis of the control object surface Fc. The determination unit 57 determines the control object surface Fc used to control the tilt axis AX4 of the bucket 8 from the plurality of design surfaces F of the target construction data. Furthermore, the determination unit 57 determines the non-control object surface Fn, which is not used to control the tilt axis of the bucket 8, from the plurality of design surfaces F of the target construction data. Among the plurality of design surfaces F of the target construction data CS, the control object surface Fc which is used to control the tilt axis AX4 of the bucket 8 is determined to be the design surface F which is the shortest distance from the bucket 8. In this embodiment, the target construction data CS including the plurality of design surfaces F is defined in a vehicle-body coordinate system. The position data of the bucket 8 (the regulation points RP) is also defined in the vehicle-body coordinate system. The determination unit 57 determines a point AP, among the target construction data CS, which is the shortest distance (vertical distance) from the bucket 8 calculated by the bucket position data calculation unit 56. The determination unit 57 determines the design surface F which contains point AP to be the control object surface Fc which is the shortest distance from the bucket 8.

The non-control object surface Fn which is not used to control the tilt axis AX4 of the bucket 8 is arranged at least partially around the control object surface Fc. The control object surface Fc and non-control object surface Fn are adjacent to one another. The distance between the control object surface Fc and the bucket 8 is shorter than the distance between the non-control object surface Fn and the bucket 8.

Furthermore, the determination unit 57 determines a working-equipment operation plane WP which passes through point AP and the bucket 8 and which orthogonally intersects the bucket axis AX3. The working-equipment operation plane WP is an operation plane in which the bucket 8 moves due to the operation of at least one of the boom cylinder 11, the arm cylinder 12, and the bucket cylinder 13, and is parallel to a plane XZ in the vehicle-body coordinate system.

The determination unit 57 also determines a line LX which represents an intersection between the working-equipment operation plane WP and the target construction data CS. Furthermore, the determination unit 57 determines a line LY which passes through point AP and intersects line LX in the target construction data CS.

The determination unit 57 determines whether or not the control object surface Fc, which has been determined on the basis of the target construction data CS acquired by the target construction data acquisition unit 55 and the position data of the regulation points RP acquired by the bucket position data calculation unit 56, has switched from a previous control object surface Fb. When the control object surface Fc is the same as the previous control object surface Fb, the control object surface Fc is maintained as the previous control object surface Fb.

When the control object surface Fc has switched from the previous control object surface Fb, the determination unit 57 determines whether or not a specific operation of the working equipment 1 is maintained on the basis of operating data acquired by the operating data acquisition unit 53. When the specific operation of the working equipment 1 is maintained, the control object surface Fc is maintained as the previous control object surface Fb. When the specific operation is not maintained, the control object surface Fc is maintained on the basis of the target construction data CS and the position data of the regulation points RP.

The working equipment control unit 61 controls the tilt axis AX4 of the bucket 8 such that the bucket 8 does not dig into the design surfaces F, on the basis of the control object surface Fc determined by the determination unit 57. Furthermore, the working equipment control unit 61 controls the bucket axis AX3 of the bucket 8 such that the bucket 8 does not dig into the design surfaces F, on the basis of the control object surface Fc determined by the determination unit 57. The working equipment control unit 61 also controls the boom 6 such that the bucket 8 does not dig into the design surfaces F. In other words, the working equipment control unit 61 executes control of the working equipment 1 including at least control of the tilt axis AX4 such that the bucket 8 tracks the control object surface Fc.

The working equipment control unit 61 causes the boom 6 and the arm 7 to move along line LX and subjects the bucket 8 to bucket rotation. The working equipment control unit 61 also subjects the bucket 8 to tilt rotation along line LY. The working equipment control unit 61 controls the tilt axis AX4 of the bucket 8 so as to maintain the relative angle in the tilt-rotation direction between the bucket 8 and line LY of the control object surface Fc.

The display control unit 62 causes the display device 80 to display display data. The display control unit 62 causes the display device 80 to generate a display such that the mode in which the control object surface Fc determined by the determination unit 57 is displayed differs from that of surfaces other than the control object surface Fc. The display control unit 62 causes the display device 80 to generate a display such that the mode in which the control object surface Fc determined by the determination unit 57 is displayed differs from that of the non-control object surface Fn.

Control Method

Figure 7:
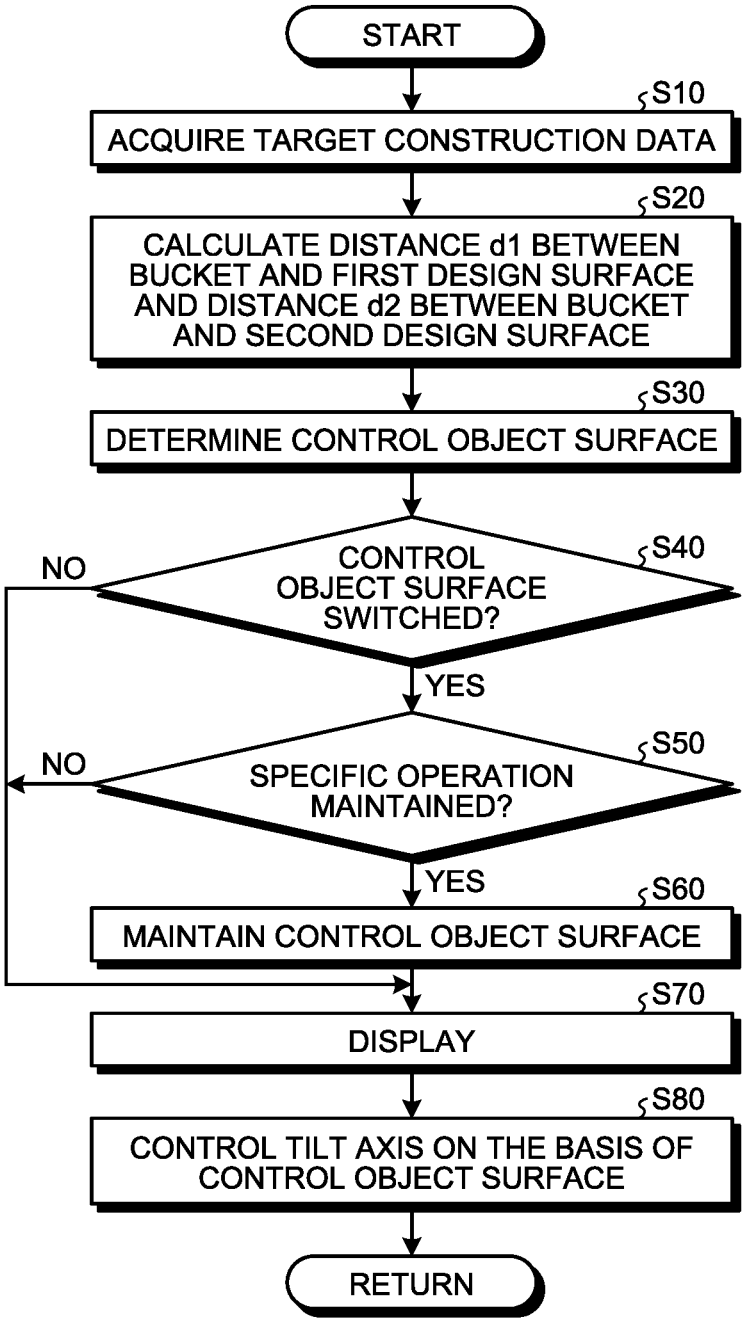
FIG. 7 is a flowchart illustrating an example of a construction machine control method according to the first embodiment.

FIG. 7 is a flowchart illustrating an example of a control method of the excavator 100 according to this embodiment.

The target construction data acquisition unit 55 acquires the target construction data CS (step S10).

The vehicle-body position data acquisition unit 51 acquires position data of the swing body 2 from the vehicle-body position calculation device 20. The angle data acquisition unit 52 acquires angle data of the working equipment 1 from the angle detection device 30. The bucket position data calculation unit 56 calculates the position of the bucket 8 (the regulation points RP) on the basis of the position data of the swing body 2, the angle data of the working equipment 1, and the working equipment data stored in the storage unit 60.

The target construction data CS includes the first design surface F1 and the second design surface F2 adjacent to the first design surface F1. The gradient of the first design surface F1 and the gradient of the second design surface F2 differ from one another. The determination unit 57 calculates a distance d1 between the bucket 8 and the first design surface F1 and a distance d2 between the bucket 8 and the second design surface F2 on the basis of the position data of the bucket 8 and the target construction data CS (step S20).

In this embodiment, the distance d1 and distance d2 are defined in a vehicle-body coordinate system. Note that the distance d1 and distance d2 may also be defined in a global coordinate system.

The determination unit 57 determines the control object surface Fc from among the first design surface F1 and the second design surface F2 on the basis of the distance d1 between the bucket 8 and the first design surface F1 and the distance d2 between the bucket 8 and the second design surface F2 (step S30).

In the description hereinbelow, by way of an example, distance d1 is shorter than distance d2, the first design surface F1 is determined as being control object surface Fc, and the second design surface F2 adjacent to the first design surface F1 is determined as being the non-control object surface Fn.

Figure 8:
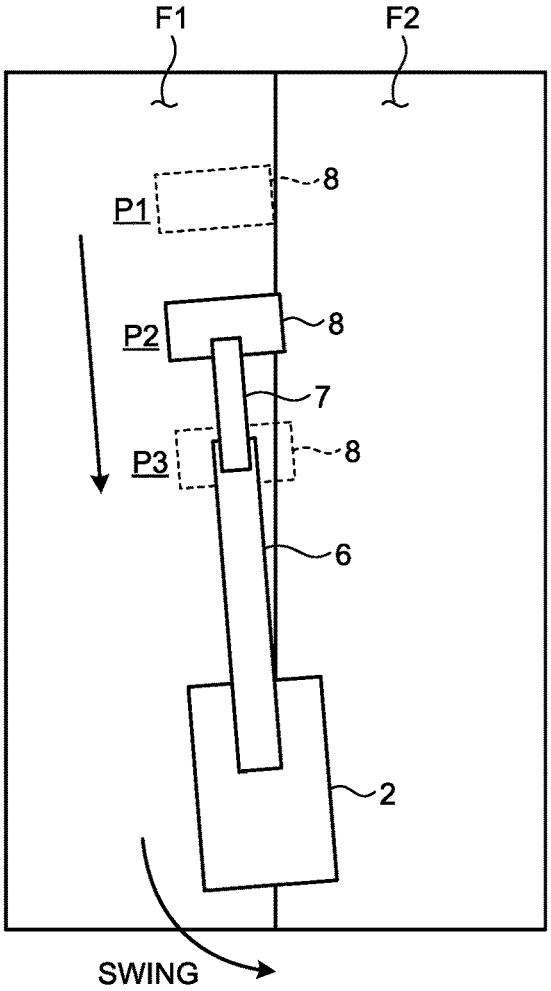
FIG. 8 is a plan view to illustrate an example of the operation of the construction machine according to the first embodiment.
Figure 9:
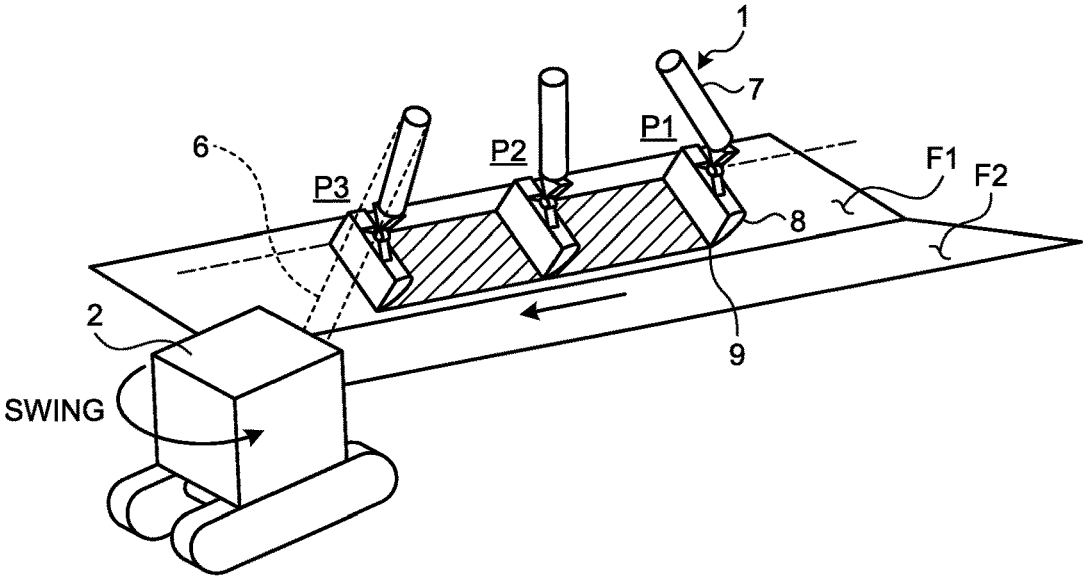
FIG. 9 is a perspective view to illustrate an example of the operation of the construction machine according to the first embodiment.

FIG. 8 is a plan view to illustrate an example of the operation of the excavator 100 according to this embodiment. FIG. 9 is a perspective view to illustrate an example of the operation of the excavator 100 according to this embodiment. As illustrated in FIGS. 8 and 9, the driver operates the operating device 40 such that the bucket 8 of which the tilt axis AX4 is controlled moves from a first position P1 on the first design surface F1 to a third position P3 via a second position P2. The first position P1 is a position on the first design surface F1 far from the swing body 2. The second position P2 is a position on the first design surface F1 which is closer to the swing body 2 than the first position P1. The third position P3 is a position on the first design surface F1 which is closer to the swing body 2 than the second position P2.

The first design surface F1 is an inclined surface which is inclined with respect to plane XY. The driver is able to form an inclined surface for the construction object by operating the operating device 40 to drive at least the arm 7 such that the bucket 8 of which the tilt axis AX4 is controlled approaches the swing body 2.

Note that, as illustrated in FIGS. 8 and 9, when the position of the center of the swing body 2 in the vehicle-width direction and the position of the center of the first design surface F1 are different, the driver may operate the operating device 40 so as to cause the swing body 2 to swing while the working equipment 1 is operated, such that the bucket 8 does not dig into the first design surface F1.

The determination unit 57 determines whether or not the control object surface Fc has been switched. In other words, the determination unit 57 determines whether or not the control object surface Fc has been switched from the first design surface F1 to the second design surface F2 on the basis of distance d1 between the bucket 8 and the first design surface F1 and distance d2 between the bucket 8 and the second design surface F2 (step S40).

When it is determined in step S40 that the control object surface Fc has been switched from the first design surface F1 to the second design surface F2 (step S40: Yes), the processing advances to step S50.

When it is determined in step S40 that the control object surface Fc has not been switched from the first design surface F1 to the second design surface F2 (step S40: No), that is, when the control object surface Fc has been maintained as the first design surface F1, the processing advances to step S70.

The operating data of the operating device 40 is acquired by the operating data acquisition unit 53. The determination unit 57 determines whether or not a specific operation has been maintained, on the basis of the operating data acquired by the operating data acquisition unit 53 (step S50).

In this embodiment, the specific operation is an operation to drive the arm 7 such that the bucket 8 moves from the first position P1 to the third position P3. The determination unit 57 determines whether or not the operation of the operating device 40 (the left-operation lever 42) for driving the arm 7 is continuing.

When it is determined in step S50 that the specific operation is maintained (step S50: Yes), during the period in which the specific operation is maintained, the determination unit 57 maintains the control object surface Fc as the first design surface F1 without switching the control object surface Fc to the second design surface F2 (step S60).

When it is determined in step S50 that the specific operation is not maintained (step S50: No), the determination unit 57 determines that the design surface F, among the first design surface F1 and the second design surface F2, which is the shortest distance from the bucket 8 is the control object surface Fc and the processing advances to step S70.

For example, when the bucket 8 is moving from the first position P1 toward the third position P3, the driver quits the operation using the operating device 40 (left-operation lever 42) to operate the arm 7, and in a case where the design surface F, among the first design surface F1 and second design surface F2, which is the shortest distance from the bucket 8 at the moment the driver quits the operation of the arm 7 is the first design surface F1, the working equipment control unit 61 controls the tilt axis AX4 of the bucket 8 such that the blade edge 9 of the bucket 8 is parallel to the first design surface F1. On the other hand, in a case where the design surface F, among the first design surface F1 and second design surface F2, which is the shortest distance from the bucket 8 at the moment the driver quits the operation of the arm 7 is the second design surface F2, the working equipment control unit 61 controls the tilt axis AX4 of the bucket 8 such that the blade edge 9 of the bucket 8 is parallel to the second design surface F2.

The display control unit 62 causes the display device 80 to generate a display such that the mode in which the control object surface Fc determined by the determination unit 57 is displayed differs from that of surfaces other than the control object surface Fc (step S70).

The working equipment control unit 61 controls the tilt axis AX4 of the bucket 8 such that the blade edge 9 of the bucket 8 and the first design surface F1 are parallel to each other, on the basis of the first design surface F1 which is the control object surface Fc determined by the determination unit 57 (step S80).

Figure 10:
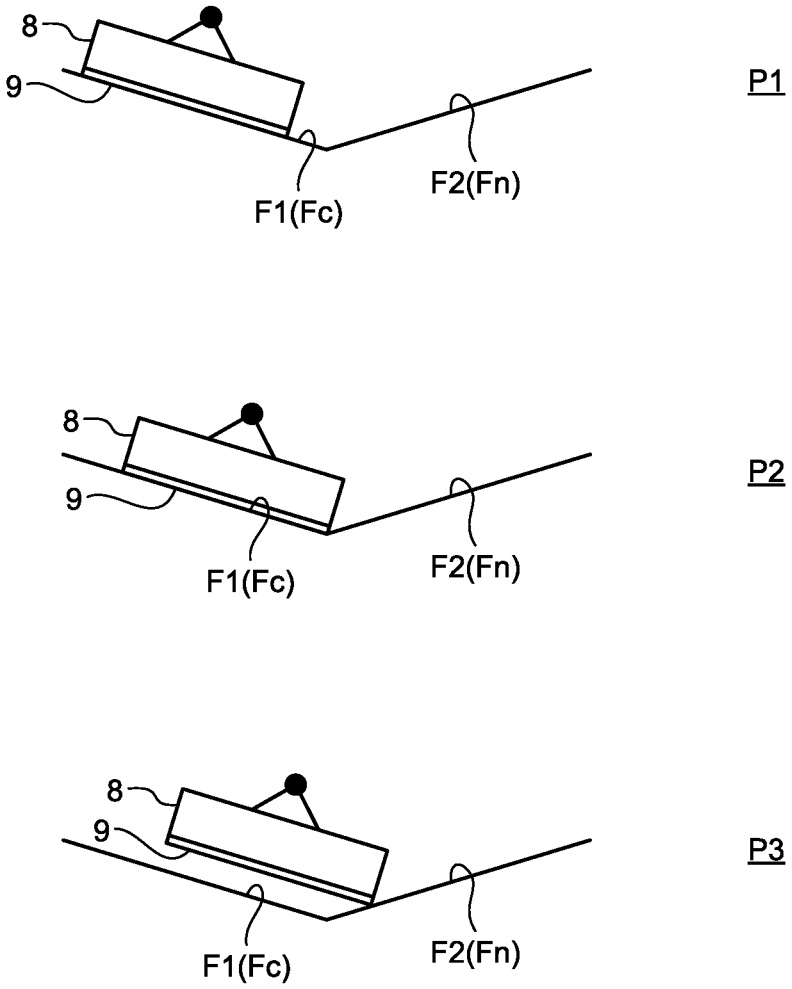
FIG. 10 is a schematic diagram to illustrate an example of the operation of the construction machine according to the first embodiment.

FIG. 10 is a schematic diagram to illustrate an example of the operation of the excavator 100 according to this embodiment. FIG. 10 illustrates the relative angle between the blade edge 9 of the bucket 8 and the first design surface F1 when the bucket 8 has moved to the first position P1, second position P2, and third position P3, respectively.

As illustrated in FIG. 10, in the first position P1 and second position P2 respectively, the design surface F, among the first design surface F1 and second design surface F2, which is the shortest distance from the bucket 8 is the first design surface F1. Therefore, the determination unit 57 determines the first design surface F1 which, among the first design surface F1 and second design surface F2, is the shortest distance from the bucket 8 as the control object surface Fc.

As illustrated in FIG. 10, in the third position P3, for example, the design surface F which is the shortest distance from the bucket 8 sometimes changes from the first design surface F1 to the second design surface F2. In this embodiment, in a case where the control object surface Fc is determined as being the first design surface F1, the determination unit 57 maintains the control object surface Fc as the first design surface F1 in the period in which the specific operation (the operation of driving the arm 7) is maintained, even when the design surface F which is the shortest distance from the bucket 8 changes from the first design surface F1 to the second design surface F2, and the working equipment control unit 61 controls the tilt axis AX4 of the bucket 8 on the basis of the control object surface Fc. In other words, in a case where the control object surface Fc is determined as being the first design surface F1, the working equipment control unit 61 controls the tilt axis AX4 of the bucket 8 such that, in the period in which the specific operation (the operation of driving the arm 7) is maintained, the relative angle between the bucket 8 in the tilt-rotation direction and the control object surface Fc (the first design surface F1) is maintained, even when the design surface which is the shortest distance from the bucket 8 changes from the first design surface F1 to the second design surface F2.

Figure 11:
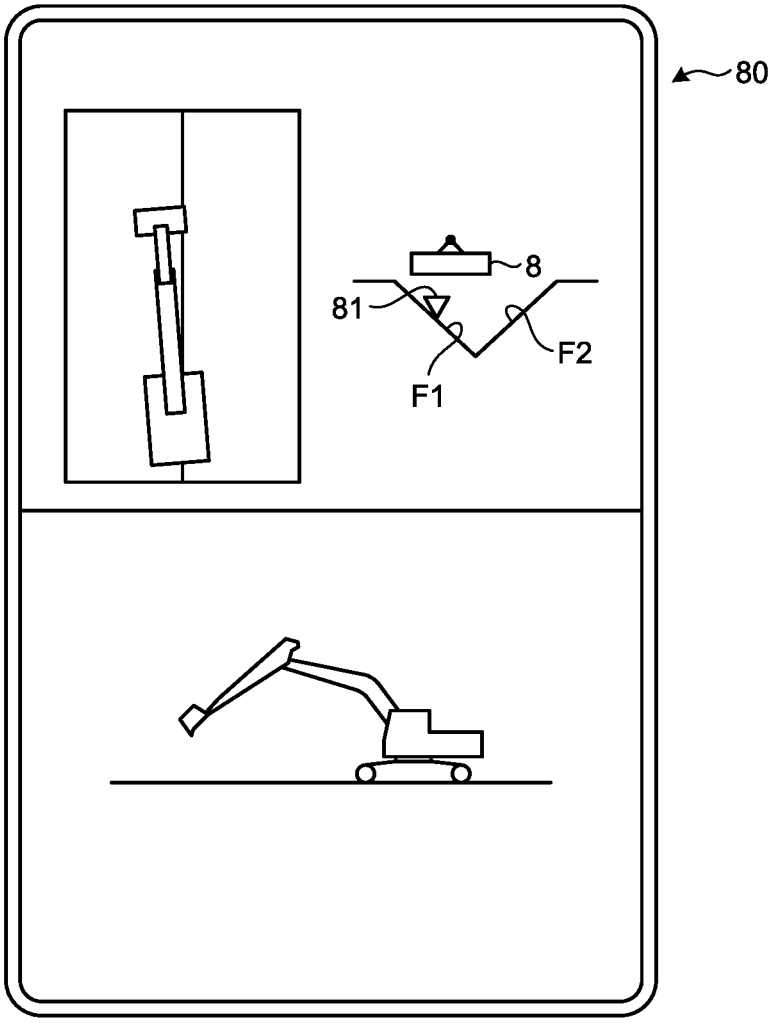
FIG. 11 is a schematic diagram illustrating an example of the display of a display device according to the first embodiment.

FIG. 11 is a schematic diagram illustrating an example of the display of the display device 80 according to this embodiment. As illustrated in FIG. 11, the display control unit 62 causes the display device 80 to display the first design surface F1 and the second design surface F2 adjacent to the first design surface F1 on the basis of the target construction data CS. In this embodiment, the gradient of the first design surface F1 and the gradient of the second design surface F2 differ from one another. As illustrated in FIG. 11, a groove (valley) is formed by the first design surface F1 and the second design surface F2. The first design surface F1 and second design surface F2 are each flat. A letter "V" shaped groove is formed by the first design surface F1 and second design surface F2.

The display control unit 62 causes the display device 80 to use different display modes to display the control object surface Fc and the non-control object surface Fn. When the first design surface F1 is determined as being the control object surface Fc and the second design surface F2 is determined as being the non-control object surface Fn, the display control unit 62 causes the display device 80 to use different display modes to display the first design surface F1 and the second design surface F2. In the example illustrated in FIG. 11, the display control unit 62 causes graphic data 81 pointing to the first design surface F1 which is the control object surface Fc to be displayed in the vicinity of the first design surface F1. The graphic data 81 is not displayed in the vicinity of the second design surface F2 which is the non-control object surface Fn. By viewing the display device 80, the driver is able to visually recognize which of the first design surface F1 and second design surface F2 is the control object surface Fc.

The driver views the display device 80 while operating the operating device 40 such that the bucket 8 approaches the first design surface F1 which is the control object surface Fc, that is, such that the bucket 8 faces (directly opposes) the first design surface F1. The driver is able to operate the operating device 40 to drive the working equipment 1 and is able to bring the bucket 8 close to the first design surface F1 which is the control object surface Fc by causing the swing body 2 to swing. Because the first design surface F1 which is the control object surface Fc is displayed using a different display mode from that of the second design surface F2, the driver is able to view the display device 80 while smoothly bringing the bucket 8 close to the first design surface F1 in a short time.

Note that the control object surface Fc and the non-control object surface Fn may be displayed on the display device 80 using different display modes. For example, the control object surface Fc may be displayed using a first color (red, for example), and the non-control object surface Fn may be displayed using a second color different from the first color (yellow, for example). For example, the control object surface Fc may be displayed so as to light up intermittently (blink), and the non-control object surface Fn may be displayed so as to be continuously lit.

The operator drives at least the arm 7 by operating the operating device 40 such that the bucket 8 moves along the second design surface F2. Note that the operator may operate the operating device 40 to drive the boom 6 or to drive both the arm 7 and the boom 6.

In other words, when the second design surface F2 is determined as being the control object surface Fc and the first design surface F1 is determined as being the non-control object surface Fn, the display control unit 62 displays the graphic data 81 pointing to the second design surface F2 which is the control object surface Fc, close to the second design surface F2, for example.

Advantageous Effects

As described hereinabove, according to this embodiment, the control object surface Fc is determined from among the first design surface F1 and the second design surface F2 on the basis of distance d1 between the bucket 8 and the first design surface F1 and distance d2 between the bucket 8 and the second design surface F2. The display control unit 62 causes the display device 80 to use different display modes to display the control object surface Fc and surfaces other than the control object surface Fc. Accordingly, the driver is able to visually recognize which of the first design surface F1 and second design surface F2 is the control object surface Fc. Thus, the driver is able to view the display device 80 while operating the operating device 40 such that the bucket 8 approaches the first design surface F1 which is the control object surface Fc, that is, such that the bucket 8 faces (directly opposes) the first design surface F1. The driver is able to view the display device 80 while smoothly bringing the bucket 8 close to the first design surface F1 in a short time. Because the time required to bring the bucket 8 close to the first design surface F1 is shortened, a reduction in the work efficiency of the excavator 100 is suppressed.

In this embodiment, it is determined whether or not a specific operation is maintained on the basis of operating data of the operating device 40, and during a period in which the specific operation is maintained, the tilt axis AX4 is controlled in a state where the control object surface Fc is maintained. For example, when the control object surface Fc is determined as being the first design surface F1, the control object surface Fc is maintained as the first design surface F1 during a period in which the specific operation is maintained even when the design surface which is the shortest distance from the bucket 8 has changed from the first design surface F1 to the second design surface F2. Contrary to the driver's wishes, tilt rotation of the bucket 8 is accordingly suppressed. That is, when the driver intends to try to construct a construction object on the basis of the first design surface F1, even though the arm 7 is being operated to move the bucket 8 of which the tilt axis AX4 is controlled on the basis of the first design surface F1 from the first position P1 to the third position P3, when the bucket 8 changes from a state where the tilt axis AX4 thereof is controlled on the basis of the first design surface F1 to a state where the tilt axis AX4 of the bucket 8 is controlled on the basis of the second design surface F2, the bucket 8 will likely dig into the design surface F significantly. In this embodiment, during a period in which the operating device 40 (the left-operation lever 42) is being operated, the working equipment control unit 61 recognizes that the driver intends to try to construct a construction object on the basis of the first design surface F1. In a case where it is recognized that the driver intends to try to construct a construction object on the basis of the first design surface F1, the working equipment control unit 61 controls the tilt axis AX4 of the bucket 8 on the basis of the first design surface F1 even when distance d2 between the bucket 8 and the second design surface F2 is shorter than distance d1 between the bucket 8 and the first design surface F1. The driver's wishes are accordingly respected, and the bucket 8 is prevented from digging into the design surface F.

Note that, in this embodiment, the specific operation is assumed to be an operation to drive the arm 7. The specific operation may also be an operation to drive the traveling body 3 of the excavator 100. For example, in a case where the bucket 8 of which the tilt axis AX4 is controlled is moved from the first position P1 to the third position P3, the traveling body 3 is sometimes made to retreat without driving the arm 7. The working equipment control unit 61 may also determine whether or not the specific operation is maintained, on the basis of the operating data of the operating device 40 (the travel lever) that operates the traveling body 3.

Second Embodiment

A second embodiment will be described next. In the description hereinbelow, the same reference signs are assigned to constituent elements which are the same as or similar to those of the foregoing embodiment, and descriptions of such elements are simplified or omitted.

In this embodiment, an example in which the control object surface Fc and the non-control object surface Fn are determined on the basis of the input data of the input device 90 will be described.

Figure 12:
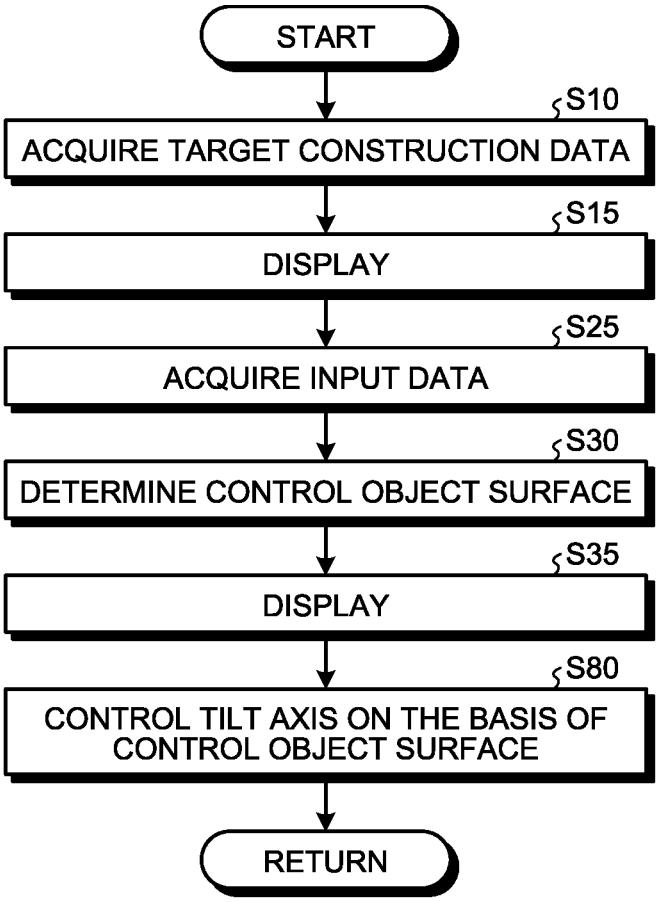
FIG. 12 is a flowchart illustrating an example of a construction machine control method according to a second embodiment.

FIG. 12 is a flowchart illustrating an example of a construction machine control method according to the second embodiment.

The target construction data acquisition unit 55 acquires the target construction data CS which includes the first design surface F1 and second design surface F2 (step S10).

The display control unit 62 causes the display device 80 to display the target construction data CS which includes the first design surface F1 and second design surface F2 (step S15).

The driver views the display device 80 while operating the input device 90 to select the control object surface Fc from among the first design surface F1 and second design surface F2 which are displayed on the display device 80. The input data acquisition unit 54 acquires the input data which is generated through the operation of the input device 90 (step S25).

The display control unit 62 may cause the display device 80 to display a first line representing a cross-section of the first design surface F1 and a second line representing a cross-section of the second design surface F2, for example. The display control unit 62 may also display the first line and the second line at different angles on the display screen of the display device 80. The driver is thus able to distinguish between the image data representing the first design surface F1 and the image data representing the second design surface F2.

The determination unit 57 determines the control object surface Fc from among the first design surface F1 and the second design surface F2 on the basis of the input data acquired by the input data acquisition unit 54 (step S30).

The display control unit 62 causes the display device 80 to use different display modes to display the first design surface F1 and the second design surface F2 (step S35).

The working equipment control unit 61 controls the tilt axis AX4 of the bucket 8 such that the blade edge 9 of the bucket 8 and the first design surface F1 are parallel to each other, on the basis of the first design surface F1 which is the control object surface Fc determined by the determination unit 57 (step S80).

Note that the first design surface F1 and the second design surface F2 may be displayed using display modes which the driver is able to visually distinguish between. For example, image data representing the first design surface F1 may be displayed using a first color (red, for example), and image data representing the second design surface F2 may be displayed using a second color different from the first color (yellow, for example). The image data representing the first design surface F1 may be displayed so as to light up intermittently (blink), and the image data representing the second design surface F2 may be displayed so as to be continuously lit. Furthermore, text data representing the first design surface F1 and second design surface F2 may also be displayed on the display device 80.

In the description hereinbelow, by way of an example, the first design surface F1 is selected by the driver as the control object surface Fc, and the first design surface F1 is determined as being the control object surface Fc by a determination unit 87 which determines the second design surface F2 adjacent to the first design surface F1 as being the non-control object surface Fn.

The vehicle-body position data acquisition unit 51 acquires position data of the swing body 2 from the vehicle-body position calculation device 20. The angle data acquisition unit 52 acquires angle data of the working equipment 1 from the angle detection device 30. The bucket position data calculation unit 56 calculates the position of the bucket 8 (the regulation points RP) on the basis of the position data of the swing body 2, the angle data of the working equipment 1, and the working equipment data stored in the storage unit 60.

Furthermore, the operator drives at least the arm 7 by operating the operating device 40 such that the bucket 8 moves along the first design surface F1. Note that the operator may operate the operating device 40 to drive the boom 6 or to drive both the arm 7 and the boom 6.

The driver operates the operating device 40 such that the bucket 8 of which the tilt axis AX4 is controlled moves from the first position P1 to the third position P3.

Advantageous Effects

As described hereinabove, according to this embodiment, the control object surface Fc is determined from among the first design surface F1 and the second design surface F2 on the basis of the input data generated through the operation of the input device 90. In other words, the driver is able to determine by themselves which of the first design surface F1 and second design surface F2 is to be the control object surface Fc. Thus, the driver is able to operate the operating device 40 such that the bucket 8 approaches the first design surface F1 which is the control object surface Fc, that is, such that the bucket 8 faces (directly opposes) the first design surface F1. Because the control object surface Fc desired by the driver is selected, even when the bucket 8 approaches the non-control object surface Fn, the bucket is prevented from digging into the design surface F when the control object surface Fc is switched. The excavator 100 can thus carry out the work smoothly. Moreover, because the time required to bring the bucket 8 close to the first design surface F1 is shortened, a reduction in the work efficiency of the excavator 100 is suppressed.

Computer System

Figure 13:
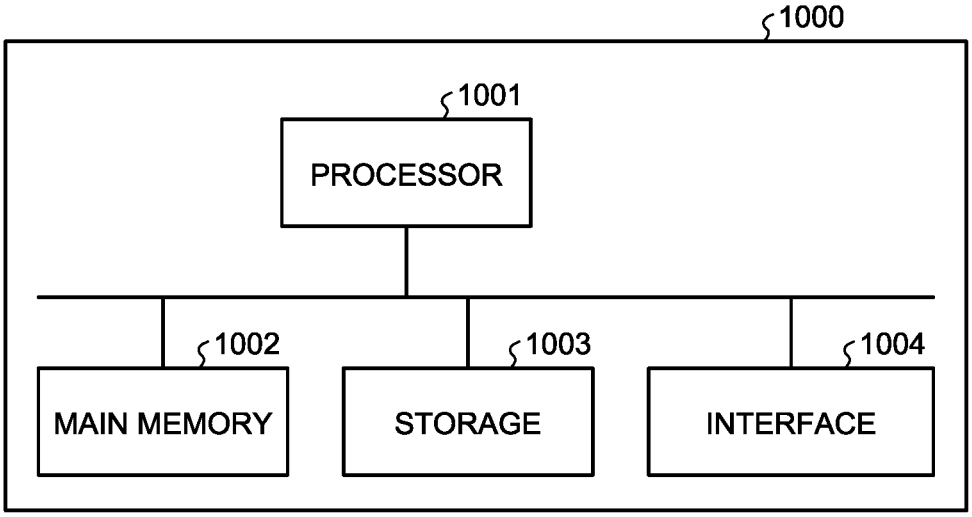
FIG. 13 is a block diagram illustrating an example of a computer system according to the embodiment.

FIG. 13 is a block diagram illustrating an example of a computer system 1000 according to the embodiment. The foregoing control device 50 includes the computer system 1000. The computer system 1000 has a processor 1001 such as a central processing unit (CPU), a main memory 1002 that includes a nonvolatile memory such as a read-only memory (ROM) and a volatile memory such as a random-access memory (RAM), a storage 1003, and an interface 1004 that includes I/O circuitry. The functions of the foregoing control device 50 are stored in the storage 1003 as a program. The processor 1001 reads the program from the storage 1003, decompresses same in the main memory 1002, and executes the foregoing processing according to the program. Note that the program may also be distributed to the computer system 1000 via a network.

The computer system 1000 is capable, according to the foregoing embodiment, of executing: acquiring target construction data representing the target shape of a construction object including the first design surface F1 and the second design surface F2 adjacent to the first design surface F1; of determining the control object surface Fc from among the first design surface F1 and the second design surface F2 on the basis of the distance d1 between the bucket 8 and the first design surface F1 and the distance d2 between the bucket 8 and the second design surface F2; of controlling the tilt axis AX4 of the bucket 8 on the basis of the control object surface Fc thus determined; and of causing the display device 80 to use different display modes to display the control object surface Fc and surfaces other than the control object surface Fc.

In addition, the computer system 1000 is capable, according to the foregoing embodiment, of executing: acquiring target construction data representing the target shape of a construction object including the first design surface F1 and the second design surface F2 adjacent to the first design surface F1; of acquiring input data generated through the operation of the input device 90; of determining the control object surface Fc from among the first design surface F1 and the second design surface F2 on the basis of the input data; and of controlling the tilt axis AX4 of the bucket 8 on the basis of the control object surface Fc thus determined.

Other Embodiments

Note that, in the foregoing embodiments, the construction machine 100 is an excavator. The constituent elements described in the foregoing embodiments are also applicable to a construction machine, which has working equipment, other than an excavator.

Note that, in the foregoing embodiments, the swing motor 16 that causes the swing body 2 to swing need not be a hydraulic motor. The swing motor 16 may also be an electric motor that performs driving by being supplied with electrical power. Moreover, the working equipment 1 may be operated independently of the hydraulic cylinders 10 by using the motive power generated by an electric actuator such as an electric motor, for example.

REFERENCE SIGNS LIST

1 WORKING EQUIPMENT
2 SWING BODY
3 TRAVELING BODY
3C CRAWLER TRACK
4 DRIVER CAB
4S SEAT
5 ENGINE
6 BOOM
7 ARM
8 BUCKET
9 BLADE EDGE
10 HYDRAULIC CYLINDER
11 BOOM CYLINDER
12 ARM CYLINDER
13 BUCKET CYLINDER
14 TILT CYLINDER
15 TRAVEL MOTOR
16 SWING MOTOR
17 HYDRAULIC PUMP
18 VALVE DEVICE
20 VEHICLE-BODY POSITION CALCULATION DEVICE
21 POSITION CALCULATOR
22 ATTITUDE CALCULATOR
23 ORIENTATION CALCULATOR
30 ANGLE DETECTION DEVICE
31 BOOM ANGLE DETECTOR
32 ARM ANGLE DETECTOR
33 BUCKET ANGLE DETECTOR
34 TILT ANGLE DETECTOR
40 OPERATING DEVICE
41 RIGHT-OPERATION LEVER
42 LEFT-OPERATION LEVER
43 TILT-OPERATION LEVER
50 CONTROL DEVICE
51 VEHICLE-BODY POSITION DATA ACQUISITION UNIT
52 ANGLE DATA ACQUISITION UNIT
53 OPERATING DATA ACQUISITION UNIT
54 INPUT DATA ACQUISITION UNIT
55 TARGET CONSTRUCTION DATA ACQUISITION UNIT
56 BUCKET POSITION DATA CALCULATION UNIT
57 DETERMINATION UNIT
60 STORAGE UNIT
61 WORKING EQUIPMENT CONTROL UNIT
62 DISPLAY CONTROL UNIT
70 TARGET CONSTRUCTION DATA SUPPLY DEVICE
80 DISPLAY DEVICE
90 INPUT DEVICE
100 CONSTRUCTION MACHINE
200 CONTROL SYSTEM
AX1 BOOM AXIS
AX2 ARM AXIS
AX3 BUCKET AXIS
AX4 TILT AXIS
F1 FIRST DESIGN SURFACE
F2 SECOND DESIGN SURFACE
Fc CONTROL OBJECT SURFACE
Fn NON-CONTROL OBJECT SURFACE

The invention claimed is:

1. A control system of a construction machine provided with working equipment which includes an arm and a tilt bucket, the control system comprising: an operating device that operates at least part of the construction machine; and a control device including a processor configured to:

determine a control object surface from a first design surface and a second design surface adjacent to the first design surface on the basis of a distance between the tilt bucket and the first design surface and a distance between the tilt bucket and the second design surface;

acquire operating data which is generated through an operation of the operating device;

determine whether or not a specific operation is maintained, on the basis of the operating data;

maintain the determined control object surface during a period in which the specific operation is maintained when the design surface which is the shortest distance from the tilt bucket has changed from the first design surface to the second design surface; and execute control of the rotation of the tilt bucket about the working equipment including control of the tilt axis with respect to the maintained control object surface.

2. The control system of the construction machine according to claim 1, the processor configured to:

acquire input data generated through an operation of an input device, wherein the control object surface is determined from the first design surface and the second design surface on the basis of the input data.

3. The control system of the construction machine according to claim 1, wherein the specific operation includes an operation to drive the arm.

4. The control system of the construction machine according to claim 3, wherein the specific operation includes an operation to drive a traveling body of the construction machine.

5. The control system of the construction machine according to claim 1, wherein as the control object surface, one of the first design surface and the second design surface is determined, which has a shorter distance from the tilt bucket, wherein, in a case where the control object surface is determined as being the first design surface, the tilt axis is controlled in a state of maintaining the control object surface as the first design surface during the period in which the specific operation is maintained, even when the one which is the shorter distance from the tilt bucket changes from the first design surface to the second design surface.

6. A control method of a construction machine provided with working equipment which includes an arm and a tilt bucket, the control method comprising:

determining a control object surface from a first design surface and a second design surface adjacent to the first design surface on the basis of a distance between the tilt bucket and the first design surface and a distance between the tilt bucket and the second design surface;

acquiring operating data which is generated through an operation of an operating device;

determining whether or not a specific operation is maintained, on the basis of the operating data;

during a period in which the specific operation is maintained, maintaining the determined control object surface when the design surface which is the shortest distance from the tilt bucket has changed from the first design surface to the second design surface; and executing control of the rotation of the tilt bucket about the working equipment including control of the tilt axis with respect to the determined control object surface.

* * * * *